US011779804B2

(12) United States Patent
Aoki et al.

(10) Patent No.: US 11,779,804 B2
(45) Date of Patent: Oct. 10, 2023

(54) PEDALING EXERCISE MACHINE AND FIXING METHOD THEREOF

(71) Applicant: TOYOTA JIDOSHA KABUSHIKI KAISHA, Toyota (JP)

(72) Inventors: Eisuke Aoki, Toyota (JP); Tomio Ikeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 102 days.

(21) Appl. No.: 17/679,187

(22) Filed: Feb. 24, 2022

(65) Prior Publication Data

US 2022/0331652 A1 Oct. 20, 2022

(30) Foreign Application Priority Data

Apr. 15, 2021 (JP) ..... 2021-068755

(51) Int. Cl.
*A63B 22/06* (2006.01)
*A61G 5/10* (2006.01)
*A63B 71/00* (2006.01)

(52) U.S. Cl.
CPC ..... *A63B 22/0694* (2013.01); *A61G 5/10* (2013.01); *A63B 22/0605* (2013.01); *A63B 71/0036* (2013.01)

(58) Field of Classification Search
CPC ..... A63B 22/0694; A63B 22/0605; A63B 71/0036; A63B 2071/0018; A63B 2071/0072; A63B 2225/09; A63B 71/0009; A63B 22/04; A63B 22/0664; A63B 23/04; A61G 5/10; A61G 5/128
See application file for complete search history.

(56) References Cited

U.S. PATENT DOCUMENTS 2,735,422 A * 2/1956 Jones ..... A63B 22/0694 601/36
3,754,547 A * 8/1973 Walker ..... A61H 1/02 601/24
5,026,225 A * 6/1991 McIntyre ..... A61G 3/0808 280/808
5,704,876 A * 1/1998 Baatz ..... A63B 21/0052 482/61
5,807,211 A * 9/1998 Berryhill ..... A63B 22/0012 482/904

(Continued)

FOREIGN PATENT DOCUMENTS

JP 2000-116818 A 4/2000
JP 2001-224636 A 8/2001

(Continued)

*Primary Examiner* — Andrew S Lo
*Assistant Examiner* — Andrew M Kobylarz
(74) *Attorney, Agent, or Firm* — Sughrue Mion, PLLC

(57) ABSTRACT

A pedaling exercise machine according to the present embodiment includes: a pair of right and left pedal portions on which feet of a user are placed; a rotation mechanism that rotates the pedal portions when the feet of the user step on the pedal portions; a seating portion that is disposed on a rear end side of the rotation mechanism separately from the rotation mechanism and on which the user is seated; a fixing member disposed on a front end side of the rotation mechanism; and a belt member that is detachably connected to the seating portion and provided to extend from the fixing member to the seating portion.

14 Claims, 9 Drawing Sheets

(56) References Cited

U.S. PATENT DOCUMENTS

| | | | | | |
|---|---|---|---|---|---|
| 5,839,995 | A * | 11/1998 | Chen | A63B 22/0605 | 482/904 |
| 6,447,428 | B1 * | 9/2002 | McKillip | A61H 1/0214 | 482/57 |
| 6,648,358 | B2 * | 11/2003 | Catanescu | A61G 5/1054 | 482/904 |
| 6,716,143 | B1 * | 4/2004 | Martin | A63B 22/001 | 482/92 |
| 6,755,768 | B1 * | 6/2004 | Garcia-Rill | A63B 22/0605 | 482/7 |

FOREIGN PATENT DOCUMENTS

| | | | |
|---|---|---|---|
| JP | 4472093 | B2 | 6/2010 |
| JP | 2019-093010 | A | 6/2019 |

* cited by examiner

PEDALING EXERCISE MACHINE AND FIXING METHOD THEREOF

CROSS-REFERENCE TO RELATED APPLICATION

This application claims priority to Japanese Patent Application No. 2021-068755 filed on Apr. 15, 2021, incorporated herein by reference in its entirety.

BACKGROUND

1. Technical Field

The present disclosure relates to a pedaling exercise machine and a fixing method thereof.

2. Description of Related Art

Japanese Unexamined Patent Application Publication No. 2000-116818 (JP 2000-116818 A) discloses a training machine by pedaling exercise. The training machine disclosed in JP 2000-116818 A includes a seat, a pair of right and left pedals, cranks, and a load device. A trainee is seated in the seat and is rotating the right and left pedals. The seat is fixed to a frame.

SUMMARY

In such a device, the trainee usually is seated on a chair or the like to perform pedaling exercise. In addition, a wheelchair user may use the pedaling exercise machine for the purpose of rehabilitation training. For example, when the seat is connected to the load device, it may be difficult for the wheelchair user to transfer to the seat. Therefore, it is preferable that the trainee be able to use the pedaling exercise machine while the trainee remains seated on the wheelchair. In other words, it is preferable that the load device of the pedaling exercise machine and the seat (wheelchair) be separated from each other. However, when the trainee seated on the wheelchair performs the pedaling exercise, there arises an issue that the relative position of the wheelchair with respect to the pedaling exercise machine is displaced due to a reaction force of the pedaling exercise. Therefore, there is a possibility that the user cannot effectively perform the pedaling exercise.

The present disclosure has been made in view of the above background, and an object of the present disclosure is to provide a pedaling exercise machine with which the user can effectively perform pedaling exercise with a simple configuration, and a fixing method thereof.

A pedaling exercise machine according to the present embodiment includes: a pair of right and left pedal portions on which feet of a user are placed, a rotation mechanism that rotates the pedal portions when the feet of the user step on the pedal portions; a seating portion that is disposed on a rear end side of the rotation mechanism separately from the rotation mechanism and on which the user is seated; a fixing member disposed on a front end side of the rotation mechanism; and a belt member that is detachably connected to the seating portion and extends from the fixing member to the seating portion.

The above-mentioned pedaling exercise machine may further include a retractor mechanism from which the belt member is pulled out and in which the belt member is retracted, and that is able to fix a pull-out position and a retracting position of the belt member at an arbitrary position. The belt member pulled out from the retractor mechanism may be detachably connected to the seating portion.

In the above-mentioned pedaling exercise machine, the fixing member may include a plate member that is disposed on a floor surface and on which the front end side of the rotation mechanism is placed and to which the front end side is detachably connected. The retractor mechanism may be provided on the plate member.

In the above-mentioned pedaling exercise machine, the plate member may be provided with a recessed portion, and a tip end side of the rotation mechanism may be partially disposed in the recessed portion.

In the above-mentioned pedaling exercise machine, a pair of the retractor mechanisms may be provided such that the retractor mechanisms are disposed on respective ends of the plate member, and a tip end of the belt member pulled out from each of the retractor mechanisms may be attached to each of right and left sides of the seating portion.

The above-mentioned pedaling exercise machine may further include an adjusting mechanism that is able to adjust a tension of the belt member when the tip end of the belt member pulled out from the retractor mechanism is attached to the seating portion.

In the above-mentioned pedaling exercise machine, the seating portion may be a wheelchair.

A fixing method of a pedaling exercise machine according to the present embodiment is a fixing method of a pedaling exercise machine including a pair of right and left pedal portions on which feet of a user are placed, a rotation mechanism that rotates the pedal portions along a circular trajectory or an elliptical trajectory when the feet of the user step on the pedal portions, a seating portion that is disposed on a rear end side of the rotation mechanism separately from the rotation mechanism and on which the user is seated, and a fixing member disposed on a front end side of the rotation mechanism. The fixing method includes: a step of extending a belt member between the fixing member and the seating portion; and a step of fixing the belt member to the seating portion.

In the above-mentioned fixing method, the belt member may be provided for a retractor mechanism, the retractor mechanism may be able to fix a pull-out position and a retracting position of the belt member at an arbitrary position, and the belt member pulled out from the retractor mechanism may be detachably connected to the seating portion.

In the above-mentioned fixing method, the fixing member may include a plate member disposed on a floor surface, a front end side of the rotation mechanism may be placed on the plate member, the plate member may be provided with the retractor mechanism, and the rotation mechanism may be detachably connected to the plate member.

In the above-mentioned fixing method, the plate member may be provided with a recessed portion, and a tip end side of the fixing mechanism may be partially disposed in the recessed portion.

In the above-mentioned fixing method, a pair of the retractor mechanisms may be provided such that the retractor mechanisms are disposed on respective ends of the plate member, and a tip end of the belt member pulled out from each of the retractor mechanisms may be attached to each of right and left sides of the seating portion.

In the above-mentioned fixing method, a tension of the belt member may be adjusted when a tip end of the belt member pulled out from the retractor mechanism is attached to the seating portion.

In the above-mentioned fixing method, the seating portion may be a wheelchair provided with wheels.

According to the present disclosure, an object is to provide a pedaling exercise machine with which the user can effectively perform pedaling exercise with a simple configuration, and a fixing method thereof.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, the present disclosure will be described through embodiments. However, the present disclosure according to the claims is not limited to the following embodiments. Moreover, all of the configurations described in the embodiments are not necessarily indispensable as means for solving the issue. In order to clarify the explanation, the following description and drawings have been omitted or simplified as appropriate. In each drawing, the same elements are designated by the same reference signs, and duplicate explanations are omitted as necessary.

Figure 1:
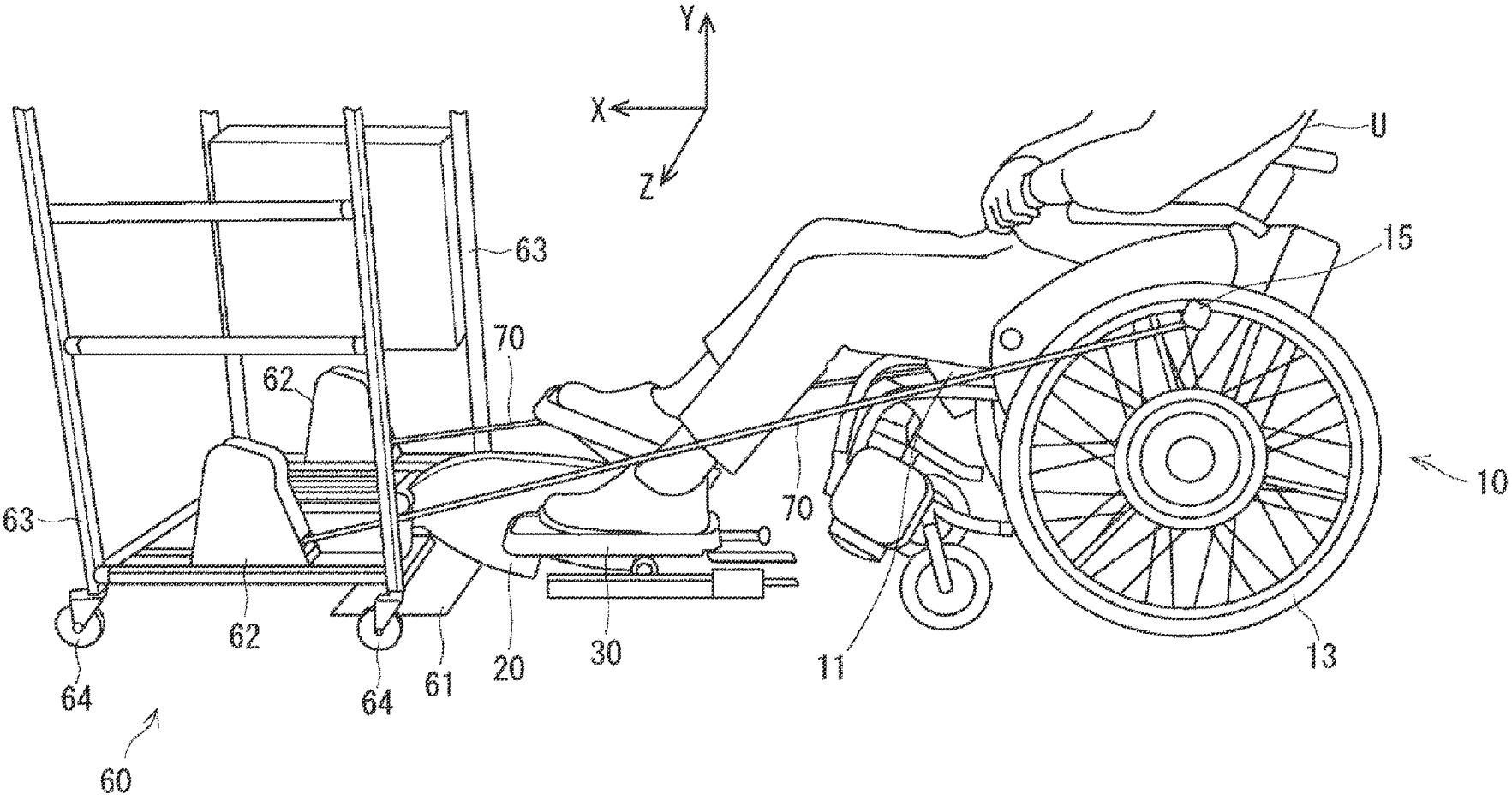
FIG. 1 is a diagram schematically showing the configuration of a pedaling exercise machine.
Figure 2:
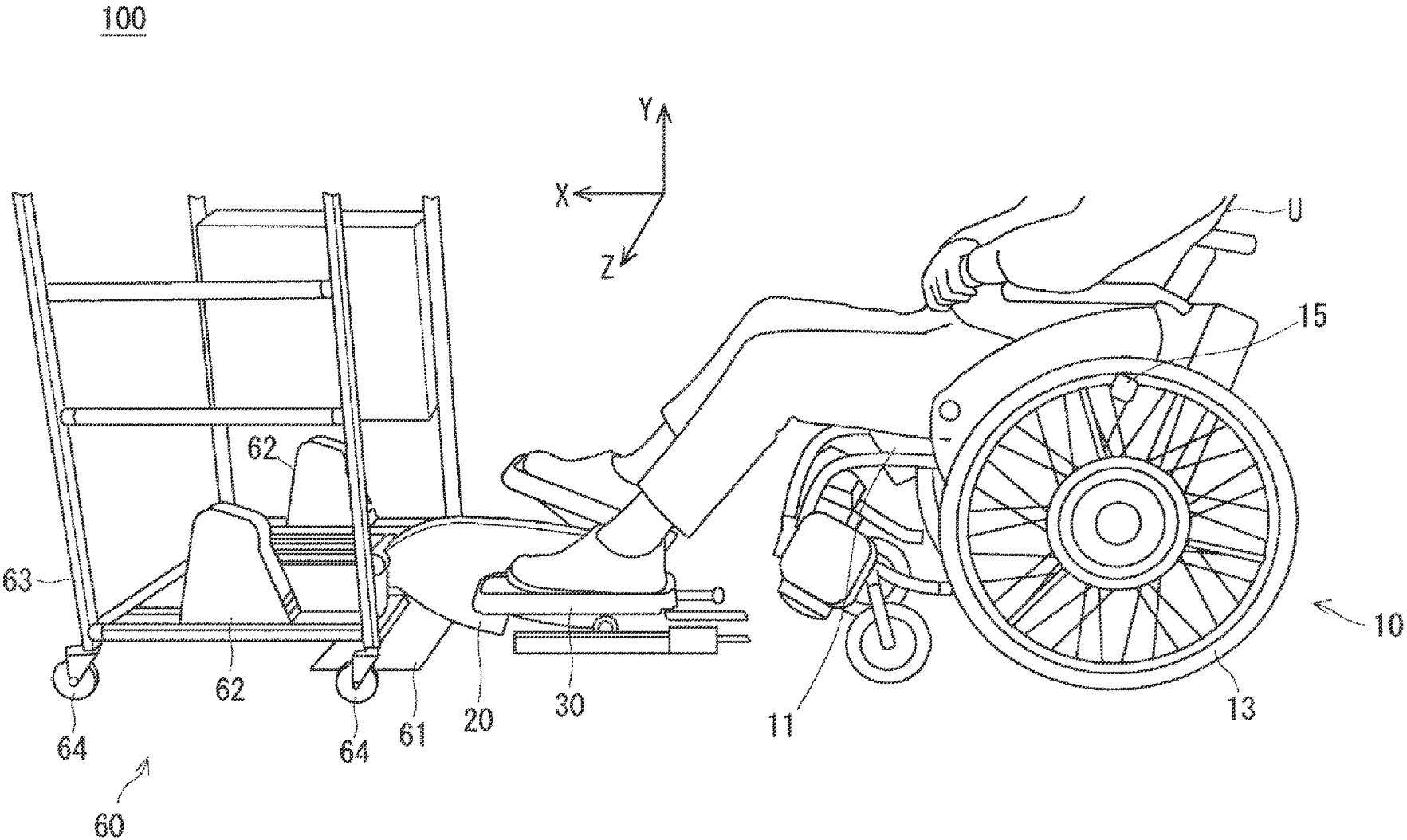
FIG. 2 is a diagram schematically showing the configuration of the pedaling exercise machine in a non-fixing state.
Figure 3:
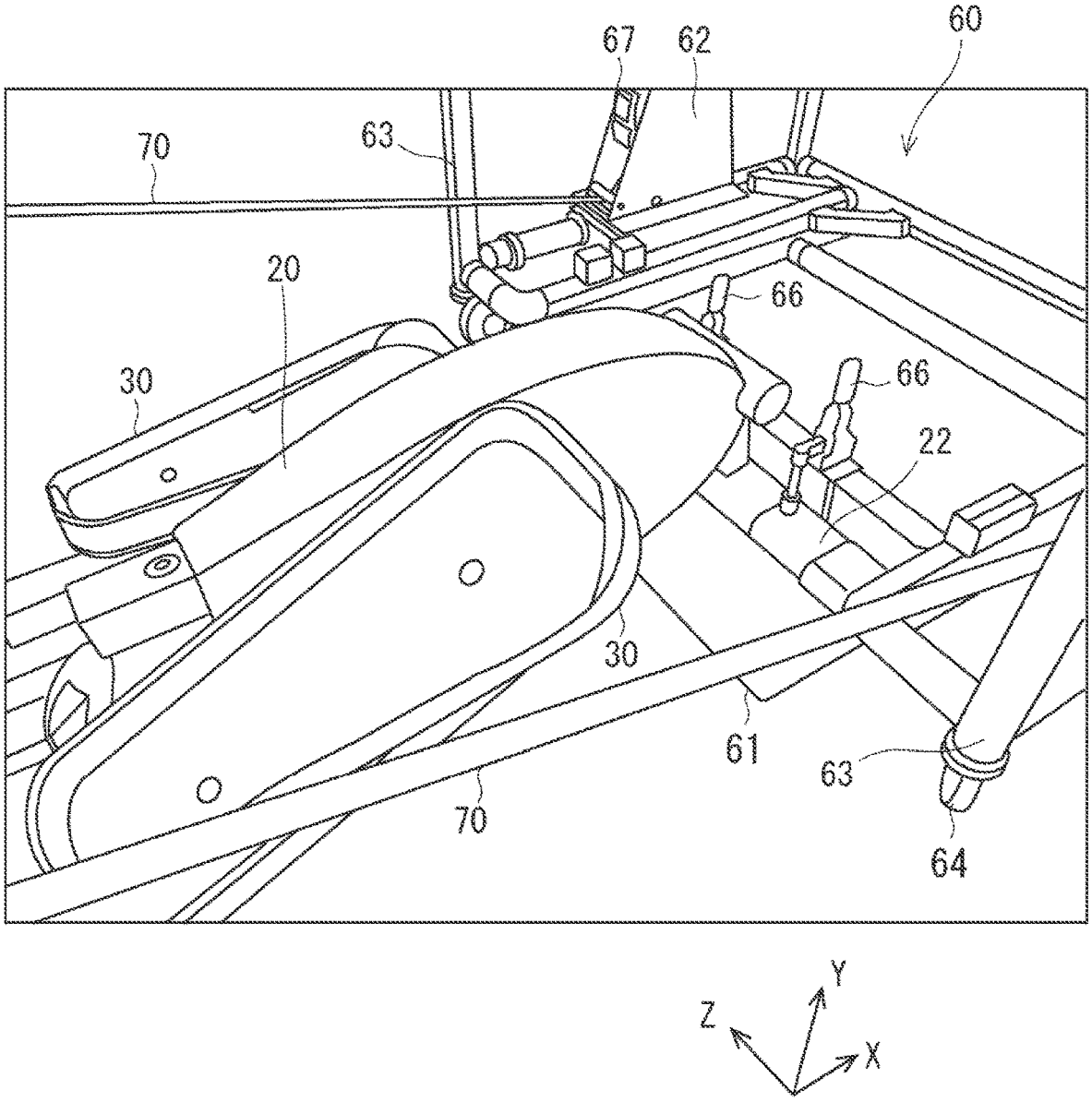
FIG. 3 is a perspective view schematically showing the configuration of a fixing mechanism of the pedaling exercise machine.
Figure 4:
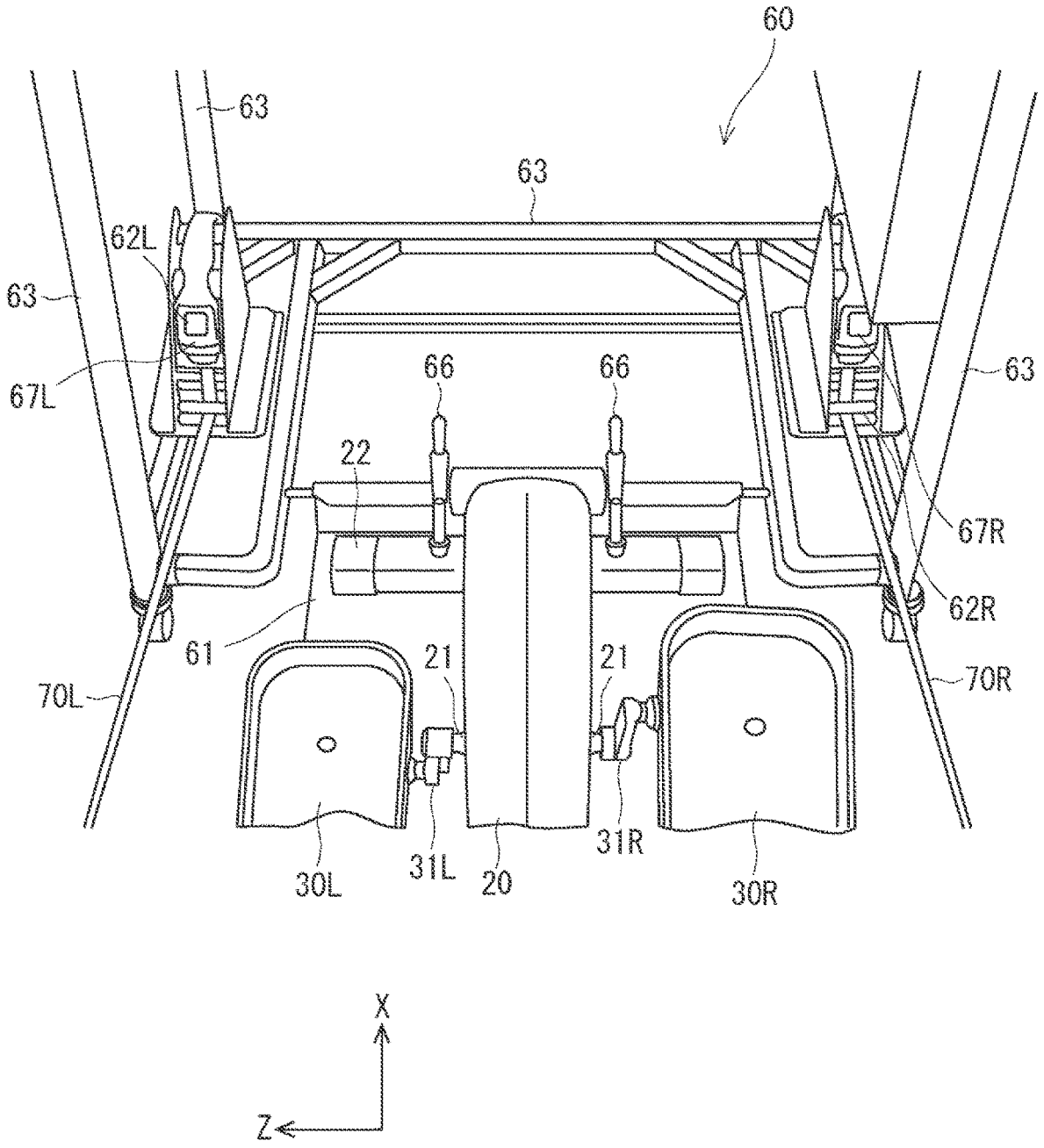
FIG. 4 is a diagram showing the configuration of the fixing mechanism of the pedaling exercise machine.

A pedaling exercise machine 100 according to the present embodiment will be described with reference to FIGS. 1 to 4. FIGS. 1 and 2 are diagrams when the pedaling exercise machine 100 is viewed in side view. FIG. 3 is a diagram when a part of the configuration of the pedaling exercise machine 100 is viewed from diagonally right rearward. FIG. 4 is a diagram when a part of the configuration of the pedaling exercise machine 100 is viewed in rear view. The pedaling exercise machine 100 is normally installed and fixed by an assistant who assists training of a user U. The assistant may be a physical therapist or an occupational therapist.

In the following description, in order to clarify the description, the XYZ three-dimensional rectangular coordinate system will be used. Specifically, the +X direction is the forward direction, the −X direction is the rearward direction, the +Y direction is the upward direction, the −Y direction is the downward direction, the +Z direction is the leftward direction, and the −Z direction is the rightward direction. The front-rear direction, the right-left direction, and the up-down direction are directions with respect to the direction of the user U.

As shown in FIGS. 1 to 4, the pedaling exercise machine 100 includes a wheelchair 10, a main body portion 20, pedal portions 30, and a fixing mechanism 60. Note that, FIG. 1 shows a state in which the fixing mechanism 60 fixes the main body portion 20 and the wheelchair 10, and FIG. 2 shows a state in which the fixing mechanism 60 does not fix the main body portion 20 and the wheelchair 10. Specifically, as shown in FIG. 1, the main body portion 20 and the wheelchair 10 are fixed using belt members 70.

In the pedaling exercise machine 100, some components are symmetrical. In FIG. 4, in order to distinguish the right and left components, L is attached to the left component and R is attached to the right component in a pair of right and left components. For example, in FIG. 4, of a pair of right and left pedal portions 30, the pedal portion 30 on the right side is indicated as a pedal portion 30R, and the pedal portion 30 on the left side is indicated as a pedal portion 30L. A crank 31R connected to the pedal portion 30R is provided on the right side of the main body portion 20. A crank 31L connected to the pedal portion 30L is provided on the left side of the main body portion 20.

Similarly, the belt member 70 on the right side is indicated as a belt member 70R, and the belt member 70 on the left side is indicated as a belt member 70L of a plate member 61. Further, other symmetrical components will be described with R or L as appropriate. Further, in the present embodiment, when the symmetrical configurations are not distinguished, each configuration may be described without adding R or L.

The main body portion 20 is a rotation mechanism that rotates the pedal portion 30 in a circular or elliptical trajectory when a foot of the user U steps on the pedal portion 30. Specifically, the crank 31R and the crank 31L are connected to the main body portion 20. The cranks 31R and 31L are rotatably attached to the main body portion 20. For example, the crank 31R and the crank 31L are connected to a rotation shaft 21 of the main body portion 20. The crank 31R and the crank 31L rotate around the rotation shaft 21. The main body portion 20 may have a load resistor that applies a load to rotational movements of the crank 31R and the crank 31L. Note that, the main body portion 20 may include a gear or the like so as to make the load variable.

The pedal portion 30 is attached to one end of each of the crank 31R and the crank 31L. The user U places his or her right foot on the pedal portion 30R and his or her left foot on the pedal portion 30R. The user U moves a knee joint and hip joint so as to step on. When the user U performs pedaling exercise, the crank 31R and the crank 31L rotate around the rotation shaft. Further, angles between the pedal portions 30R, 30L and the crank 31R, the crank 31L, respectively, vary in accordance with the rotation of the crank 31R and the crank 31L. The crank 31R and the crank 31L rotate such that the pedal portions 30 move along an elliptical trajectory or a circular trajectory in accordance with the pedaling exercise of the user U. The main body portion 20 may be portable.

The wheelchair 10 is provided behind the main body portion 20. The user U performs the pedaling exercise in a state where the user U is seated on the wheelchair 10. The wheelchair 10 is a seating portion on which the user U is seated. The wheelchair 10 may be an electric wheelchair. The wheelchair 10 includes a seat 11 and wheels 13. The seat 11 includes a seating surface on which the user U is seated and a backrest. The wheels 13 are disposed on the right and left sides of the seat 11. That is, the wheelchair 10 includes a right wheel and a left wheel. Further, the wheelchair 10 includes a fixing portion 15 for fixing the belt member that will be described later. The wheelchair 10 is disposed on the rear end side of the main body portion 20 separately from the main body portion 20.

A fixing mechanism 60 is disposed in front of the main body portion 20. The fixing mechanism 60 is disposed separately from the main body portion 20 and the wheelchair 10. The fixing mechanism 60 is a mechanism for fixing the wheelchair 10 to the main body portion 20. The fixing mechanism 60 includes the plate member 61, retractor mechanisms 62, a frame 63, casters 64, and the like.

The frame 63 is composed of metal pipes or the like extending in each of the X, Y, and Z directions. The frame 63 supports the plate member 61, the retractor mechanisms 62, the casters 64, and the like. That is, the plate member 61, the retractor mechanisms 62, the casters 64, and the like are attached to the frame 63.

As shown in FIGS. 3 and 4, the plate member 61 is disposed on the floor surface. The plate member 61 is provided parallel to the floor surface and is in contact with the floor surface. The plate member 61 is disposed at the center of the frame 63 in the right-left direction. That is, the frame 63 extends toward both of the right and left sides of the plate member 61. The frame 63 is open on the main body portion 20 side, that is, on the rear side. With this configuration, the main body portion 20 can be installed in the frame 63. The tip end side of the main body portion 20 is placed on the plate member 61. The main body portion 20 is detachably connected to the plate member 61.

Specifically, as shown in FIGS. 3 and 4, leg portions 22 extending in the right-left direction are provided on the tip end side of the main body portion 20. The leg portions 22 are placed on the plate member 61. The plate member 61 is provided with clamp mechanisms 66 for fixing the leg portions 22. When the clamp mechanisms 66 clamp the leg portions 22, the main body portion 20 is connected to the plate member 61. The fixing mechanism 60 can fix the main body portion 20.

The casters 64 are provided on the frame 63. By providing the casters 64, the fixing mechanism 60 can be easily moved. The casters 64 are each provided with a lock mechanism. Therefore, the caster 64 is locked during the pedaling exercise. It is possible to suppress the fixing mechanism 60 from being displaced. As a matter of course, the casters 64 can be omitted.

The plate member 61 is provided with the retractor mechanisms 62. The retractor mechanisms 62 are disposed on the front end side of the main body portion 20. The retractor mechanisms 62 are disposed on the right and left sides of the plate member 61, respectively. The belt member 70 is wound around the retractor mechanism 62. In FIG. 4, the retractor mechanism 62 and the belt member 70 provided on the left side of the plate member 61 are referred to as the retractor mechanism 62L and the belt member 70L. The retractor mechanism 62 and the belt member 70 provided on the right side of the plate member 61 are referred to as the retractor mechanism 62R and the belt member 70R.

For example, the retractor mechanism 62 is provided with a retracting reel or the like for retracting the belt member 70. The belt member 70 is retracted by the retractor mechanism 62. Further, the belt member 70 is pulled out from the retractor mechanism 62. The retractor mechanism 62 can fix a retracting position or a pull-out position of the belt member 70 at an arbitrary position. For example, the retractor mechanism 62 includes a mechanism for locking the retracting position or the pull-out position of the belt member 70.

The tip end of the belt member 70 is attached to the wheelchair 10. Specifically, the seat 11 or the wheel 13 is provided with a fixing portion 15 for fixing the belt member 70. For example, the fixing portion 15 has a pin shape extending in the right-left direction or a hook shape. Alternatively, the tip end side of the belt member 70 may have a shape such as a hook. When the assistant hooks the tip end of the belt member 70 on the fixing portion 15, the tip end of the belt member 70 is fixed to the wheelchair 10. Then, the retractor mechanism 62 fixes the pull-out position (retracting position) of the belt member 70. Removing the tip end of the belt member 70 from the fixing portion 15 allows the retractor mechanism 62 to retract or pull out the belt member 70.

As described above, the tip end of the belt member 70 pulled out from the retractor mechanism 62 is detachably connected to the wheelchair 10. During the pedaling exercise, the belt member 70 is attached to the fixing portion 15 as shown in FIG. 1. With this configuration, the fixing mechanism 60 fixes the wheelchair 10. That is, the retractor mechanism 62 can fix the position of the wheelchair 10 with respect to the main body portion 20.

The user U can effectively perform the pedaling exercise. For example, it is possible to suppress the wheelchair 10 from tilting rearward due to the reaction force of the pedaling exercise. Further, it is possible to suppress the position of the wheelchair 10 from being displaced with respect to the main body portion 20 due to the reaction force of the pedaling exercise. That is, the user U can perform the pedaling exercise while the distance between the main body portion 20 and the wheelchair 10 is kept constant. The user U can perform the pedaling exercise in an appropriate posture. With a simple configuration, the user U can perform the pedaling exercise effectively.

Before the start of or after the end of the pedaling exercise, the belt member 70 is removed from the fixing portion 15 as shown in FIG. 2. With this configuration, the user U can move to a position where the user U performs the pedaling exercise while being seated on the wheelchair 10. Further, the user U can perform the pedaling exercise without transferring from the wheelchair 10. Therefore, it can contribute to prevention of frailty.

Further, the main body portion 20, the fixing mechanism 60, and the wheelchair 10 are separated from each other. With this configuration, the main body portion 20 and the fixing mechanism 60 can be easily moved. Further, removing the belt members 70 makes it easier for the user U to move in the wheelchair 10. Further, the belt members 70 that are retractably provided is used. Therefore, it is not necessary to install rails or the like on the ground. Therefore, this makes it easier for the user U to move in the wheelchair 10. The wheelchair 10 can be fixed in a small and simple configuration. The wheelchair 10 can be fixed while the user U is seated on the wheelchair 10.

The retractor mechanisms 62R and 62L are provided on the respective sides of the plate member 61. The tip ends of the belt members 70R and 70L pulled out from the retractor mechanisms 62R and 62L are attached to the right and left sides of the wheelchair 10, respectively. With this configuration, the user U seated on the wheelchair 10 can move to the pedaling position from either the right or left side of the pedaling exercise machine 100. Therefore, the degree of flexibility of the installation space can be increased. As a matter of course, the retractor mechanism 62 and the belt member 70 may be provided on only one of the right and left sides. That is, when the direction in which the wheelchair 10 moves to the position where the pedaling exercise is performed is determined, only one of the belt members 70 may be detachably provided. Even when the direction in which the wheelchair 10 moves to the position where the pedaling exercise is performed is not determined, only one belt member 70 may be detachably provided so as to coincide with the central axis of the pedaling exercise machine 100.

Further, the retractor mechanism 62 includes an adjusting mechanism 67 capable of adjusting the tension of the belt member 70. When the tip ends of the belt members 70R and 70L pulled out from the retractor mechanism 62R and 62L are attached to the wheelchair 10, adjusting mechanism 67R and 67L adjust the tension of the belt members 70R and 70L. Specifically, the adjusting mechanism 67 can lock the retracting position and the pull-out position of the belt member 70. Further, the adjusting mechanism 67 can change the tension of the belt member 70 by pulling the belt member 70 while the belt member 70 is locked. With this configuration, sufficient tension can be generated to fix the position of the wheelchair 10 with respect to the main body portion 20. In addition, the belt member 70 can be suppressed from being deflected. Therefore, it is possible to suppress the wheelchair 10 from being displaced due to the reaction force of the pedaling exercise, whereby stable pedaling exercise becomes possible.

Further, use of the belt member 70 makes it possible to correspond to various types of wheelchairs 10. That is, since there is no limitation on the fixing position of the belt member 70 in the wheelchair 10, the wheelchair 10 having various shapes and sizes can be fixed to the main body portion 20. For example, the belt member 70 can be fixed to the wheelchair 10 regardless of a wheel width of the wheelchair 10. To fix the wide wheelchair 10, the two belt members 70 may be pulled out while widening the distance between the belt members 70 in the Y direction. To fix the narrow wheelchair 10, the two belt members 70 may be pulled out while keeping the distance between the belt members 70 in the Y direction close to each other. The wheelchairs 10 of various sizes can be fixed to the main body portion 20.

Figure 5:
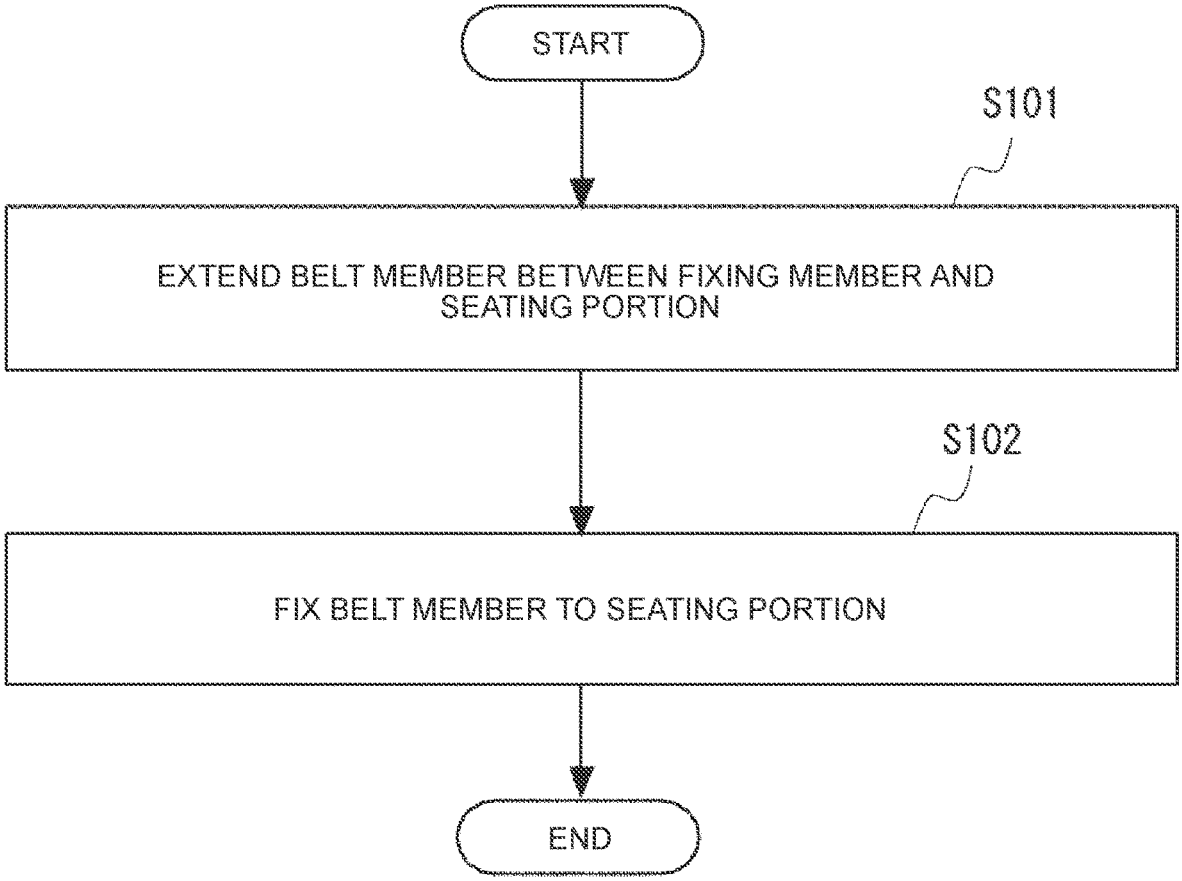
FIG. 5 is a flowchart showing a fixing method of the pedaling exercise machine.

A fixing method of the pedaling exercise machine according to the present embodiment will be described with reference to FIG. 5. First, the assistant extends the belt member 70 between the fixing member and the seating portion (S101). That is, the belt member 70 is pulled out from the retractor mechanism 62 of the fixing mechanism 60 toward the wheelchair 10. With this configuration, the belt member 70 is provided so as to extend between the wheelchair 10 and the fixing mechanism 60.

The assistant fixes the belt member 70 to the seating portion (S102). For example, the tip end of the belt member 70 is hooked on the fixing portion 15. With this configuration, the belt member 70 is fixed to the wheelchair 10. Further, the adjusting mechanism 67 may lock the belt member 70. With this configuration, the pull-out position or the retracting position is fixed.

The user U can effectively perform the pedaling exercise while the user U remains seated on the wheelchair 10 using the fixing method above. That is, after the user U moves to a position behind the main body portion 20, the wheelchair 10 and the main body portion 20 are fixed as shown in FIG. 5. Therefore, an effective pedaling exercise becomes possible with a simple configuration. Further, the assistant or the like may adjust the tension of the belt member 70 using the adjusting mechanism 67.

The seating portion on which the user U is seated is not limited to the wheelchair 10. For example, the seating portion may be an ordinary chair. In this case, the assistant may move the fixing mechanism 60 and the main body portion 20 to the front side of the user U. Further, the material of the belt member 70 is not particularly limited. For example, the belt member 70 can be made of metal or resin.

First Modification

Figure 6:
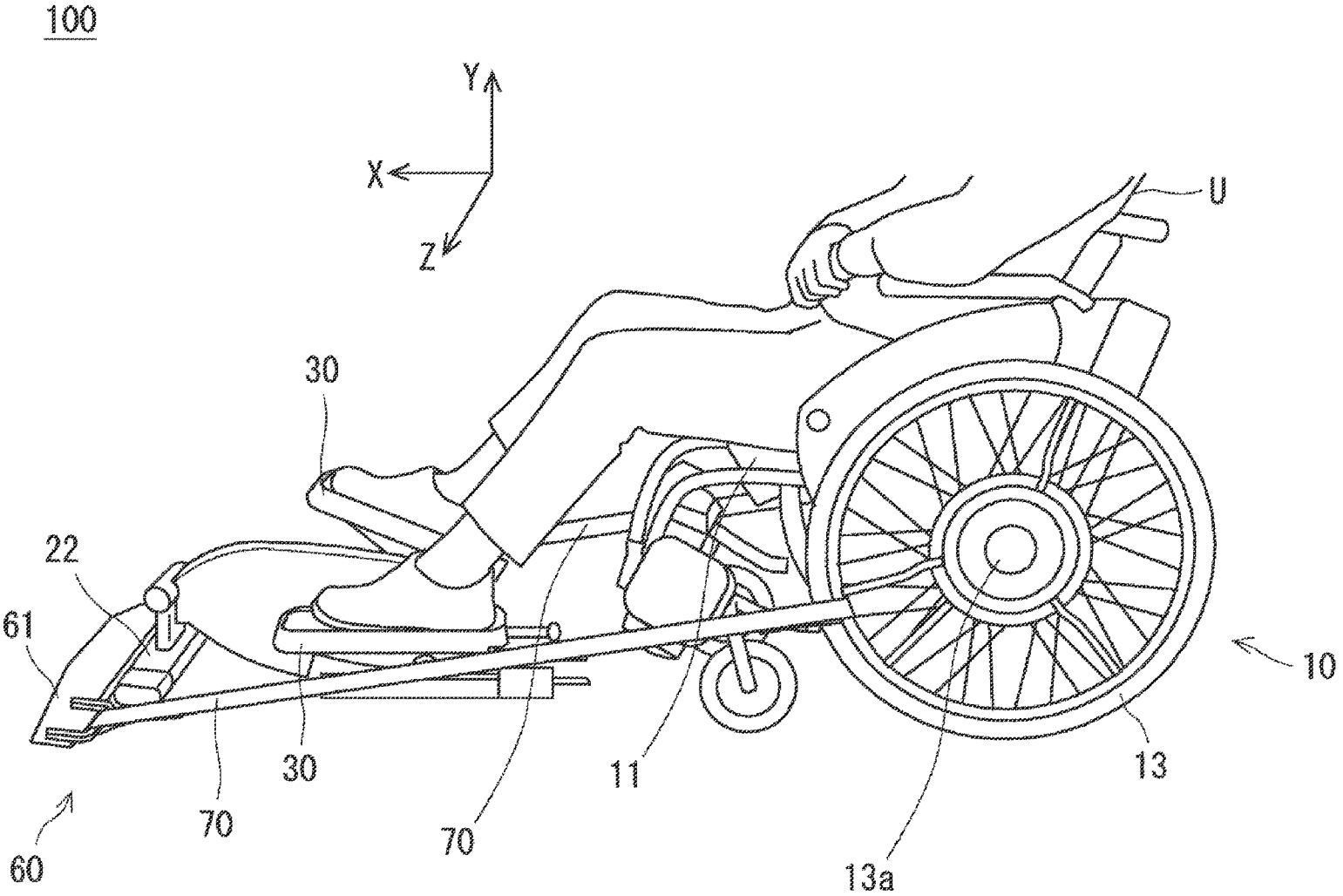
FIG. 6 is a diagram showing a pedaling exercise machine according to a first modification.

The pedaling exercise machine 100 according to a first modification will be described with reference to FIG. 6. In FIG. 6, the configuration of the fixing mechanism 60 is different from that of the first embodiment. Specifically, the fixing mechanism 60 is not provided with the retractor mechanism 62 or the like. The plate member 61 is disposed on the tip end side of the main body portion 20. The plate member 61 is a fixing member to which the belt member 70 is fixed. That is, one end of the belt member 70 is attached to the plate member 61.

The plate member 61 is a base that can be slipped under the main body portion 20. The main body portion 20 presses the plate member 61 from above. Since the plate member 61 is pressed during pedaling, the plate member 61 is stabilized.

The other end of the belt member 70 is attached to the wheelchair 10. Specifically, the belt member 70 is attached to the wheel 13 of the wheelchair 10. The wheel 13 is braked. The belt member 70 is, for example, a hook-and-loop fastener. For example, the assistant winds the belt member 70 around the wheel or frame of the wheel 13 and fixes the belt member 70 with a hook-and-loop fastener. The wheel 13 is locked by the brake of the wheelchair 10. With this configuration, the belt member 70 can suppress the wheelchair 10 from being displaced. Further, it is preferable that an axle 13*a* is positioned on the extension line of the belt member 70.

The fixing member for fixing the belt member 70 is not limited to the plate member 61. That is, any shape may be used as long as the fixing member is disposed on the tip side of the main body portion 20. For example, a support column or the like extending from the floor surface may be used as a fixing member.

Second Modification

Figure 7:
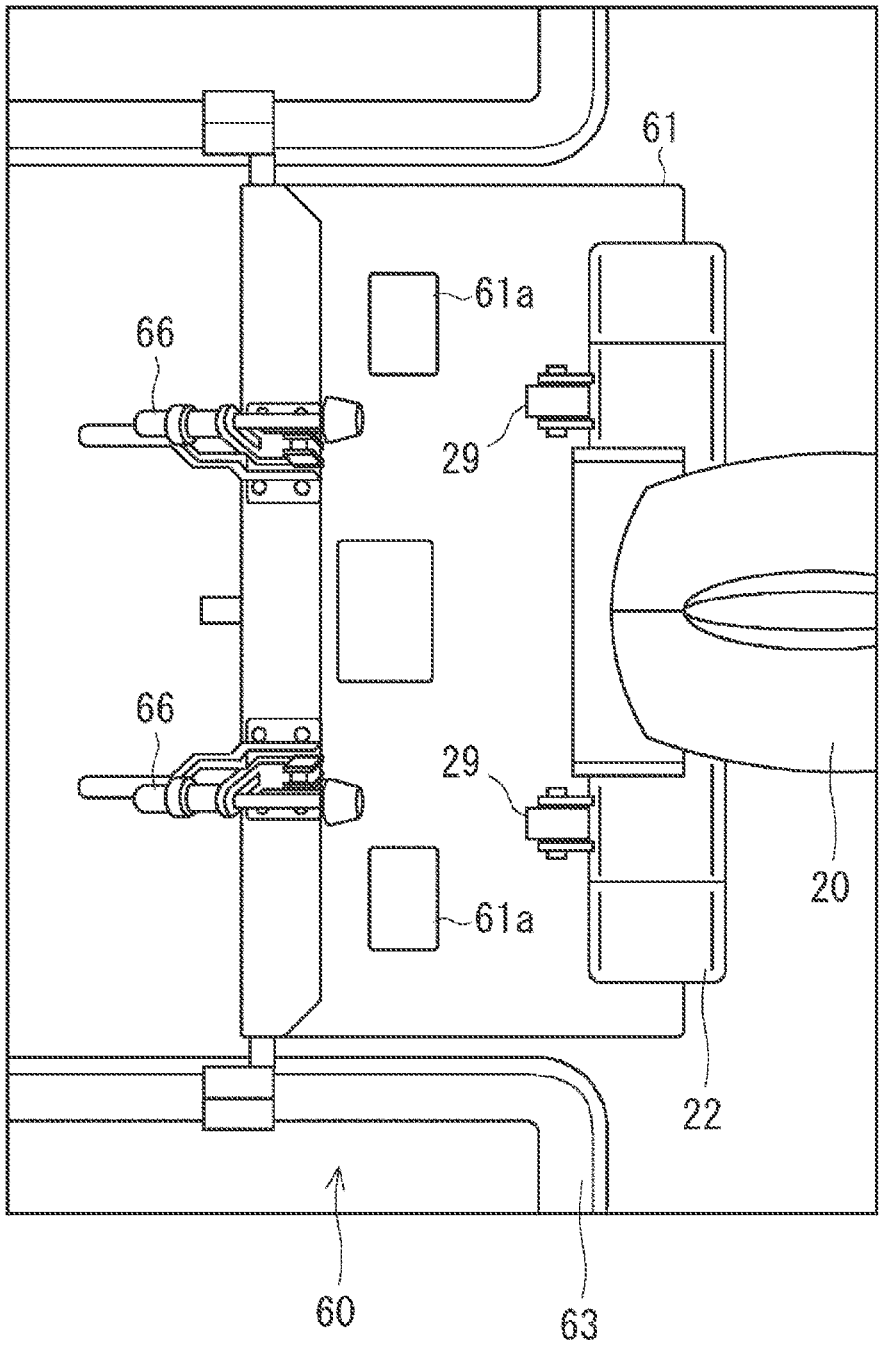
FIG. 7 is a diagram showing the configuration of a front end side of a pedaling exercise machine according to a second modification.

The pedaling exercise machine 100 according to a second modification will be described. FIG. 7 is a diagram schematically showing a configuration of the main body portion 20 on the tip end side. In the second modification, the plate member 61 is provided with recessed portions 61*a*. Then, the main body portion 20 is disposed inside the recessed portions 61*a*. For example, projection portions are provided on the lower surface side of the main body portion 20. The projection portions of the main body portion 20 are disposed in the recessed portion 61*a*.

Wheels 29 are provided for the leg portions 22 of the main body portion 20. With this configuration, the main body portion 20 can be easily installed. The assistant moves the main body portion 20 from the rear toward the plate member 61. Then, the wheels 29 roll on the plate member 61 such that the leg portions 22 can be placed on the plate member 61. Then, the protruding portions of the main body portion 20 are disposed in the recessed portions 61*a* of the plate member 61. With this configuration, the plate member 61 and the main body portion 20 can be stabilized.

As described above, uneven shapes are provided for the plate member 61 and the main body portion 20 such that the main body portion 20 can be positioned with respect to the plate member 61. Further, the main body portion 20 and the plate member 61 can be integrated. As a matter of course, the uneven shapes may be reversed. That is, the main body portion 20 may be provided with the recessed portions, and the plate member 61 may be provided with the protruding portions.

Figure 8:
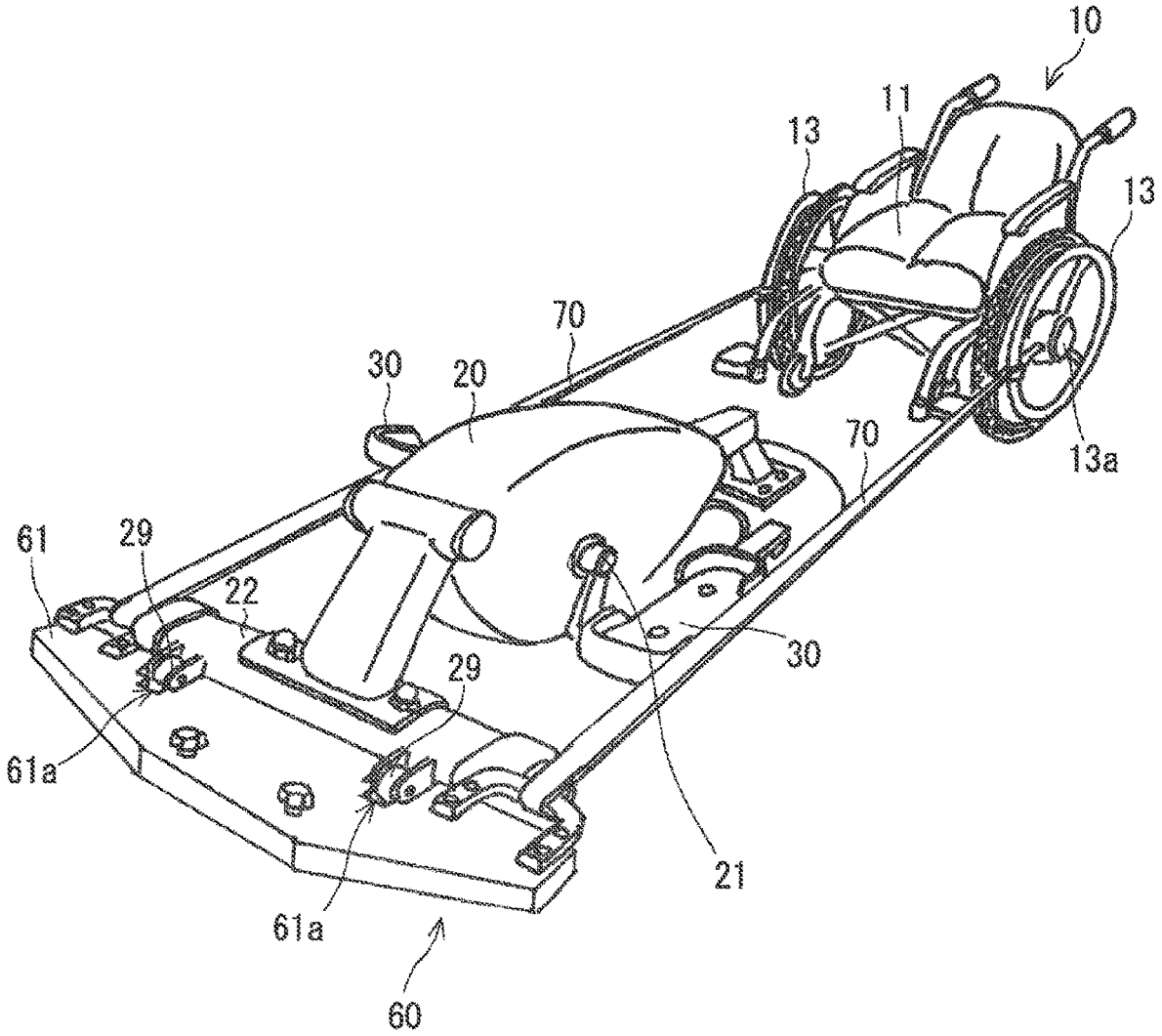
FIG. 8 is a diagram showing the configuration of a front end side of a pedaling exercise machine according to another aspect of the second modification.

FIG. 8 is a diagram showing another aspect of the second modification. Specifically, FIG. 8 is a perspective view showing an example in which the plate member 61 is provided with the recessed portions 61*a*. Further, the wheels 29 of the main body portion 20 are provided as protruding portions protruding downward. Each of the wheels 29 is disposed in the recessed portion 61*a* of the plate member 61. The wheel 29 fits into the recessed portion 61*a*. With this configuration, the plate member 61 and the main body portion 20 can be stably disposed. Further, positioning in the right-left direction can be easily performed.

Figure 9:
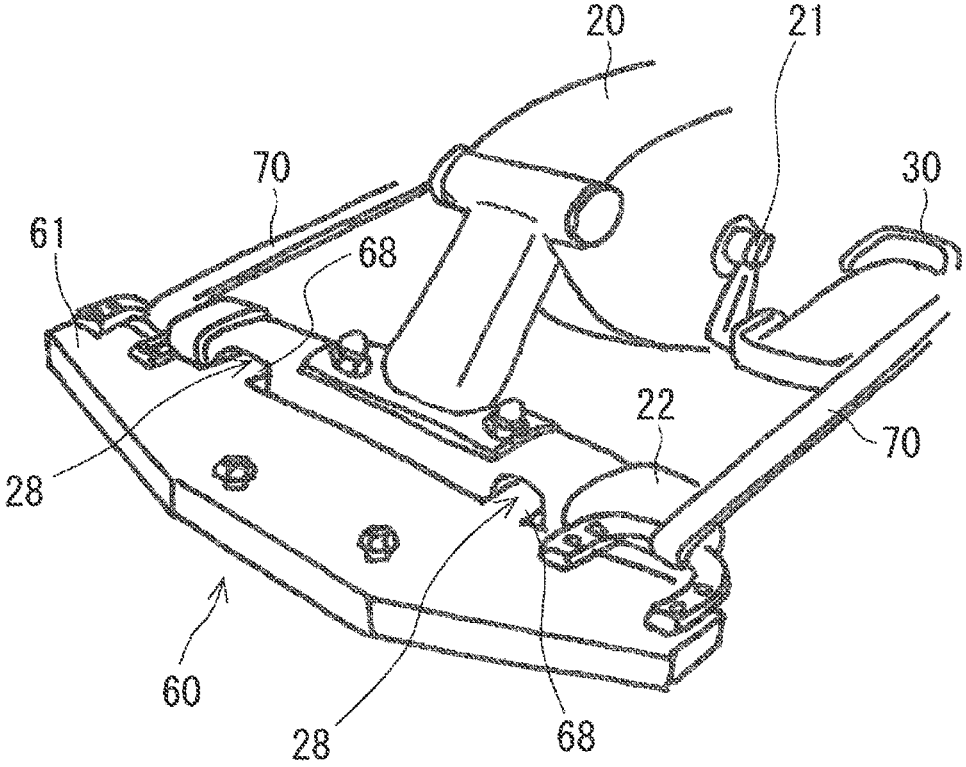
FIG. 9 is a diagram showing the configuration of the front end side of the pedaling exercise machine according to the other aspect of the second modification.

FIG. 9 is a diagram showing another aspect of the second modification. In FIG. 9, recessed portions 28 are provided in the main body portion 20. Specifically, the recessed portions 28 are provided forward of the leg portions 22. The plate member 61 is provided with protruding portions 68 projecting rearward. Each of the protruding portions 68 is disposed in the recessed portion 28. That is, the protruding portion 68 is inserted into the recessed portion 28. With this configuration, positioning in the right-left direction can be easily performed.

The present disclosure is not limited to the above embodiments, and can be appropriately modified without departing from the spirit.

What is claimed is:

1. A pedaling exercise machine comprising:

a pair of right and left pedal portions on which feet of a user are configured to be placed, a rotation mechanism that rotates the pedal portions when the feet of the user step on the pedal portions;

a seating portion that is disposed on a rear end side of the rotation mechanism separately from the rotation mechanism and on which the user is seated;

a fixing member disposed on a front end side of the rotation mechanism; and a belt member that is detachably connected to the seating portion and extends from the fixing member to the seating portion.

2. The pedaling exercise machine according to claim 1, further comprising a retractor mechanism from which the belt member is pulled out and in which the belt member is retracted, and that is able to fix a pull-out position and a retracting position of the belt member at an arbitrary position, wherein the belt member pulled out from the retractor mechanism is detachably connected to the seating portion.

3. The pedaling exercise machine according to claim 2, wherein:

the fixing member includes a plate member that is disposed on a floor surface and on which the front end side of the rotation mechanism is placed and to which the front end side is detachably connected; and the retractor mechanism is provided on the plate member.

4. The pedaling exercise machine according to claim 3, wherein:

the plate member is provided with a recessed portion; and a tip end side of the rotation mechanism is partially disposed in the recessed portion.

5. The pedaling exercise machine according to claim 3, wherein a pair of the retractor mechanisms is provided such that the retractor mechanisms are disposed on respective ends of the plate member, and a tip end of the belt member pulled out from each of the retractor mechanisms is attached to each of right and left sides of the seating portion.

6. The pedaling exercise machine according to claim 2, further comprising an adjusting mechanism that is able to adjust a tension of the belt member when the tip end of the belt member pulled out from the retractor mechanism is attached to the seating portion.

7. The pedaling exercise machine according to claim 1, wherein the seating portion is a wheelchair.

8. A fixing method of a pedaling exercise machine including a pair of right and left pedal portions on which feet of a user are configured to be placed, a rotation mechanism that rotates the pedal portions along a circular trajectory or an elliptical trajectory when the feet of the user step on the pedal portions, a seating portion that is disposed on a rear end side of the rotation mechanism separately from the rotation mechanism and on which the user is seated, and a fixing member disposed on a front end side of the rotation mechanism, the fixing method comprising:

a step of extending a belt member between the fixing member and the seating portion; and a step of fixing the belt member to the seating portion.

9. The fixing method according to claim 8, wherein:

the belt member is provided for a retractor mechanism;

the retractor mechanism is able to fix a pull-out position and a retracting position of the belt member at an arbitrary position; and the belt member pulled out from the retractor mechanism is detachably connected to the seating portion.

10. The fixing method according to claim 9, wherein:

the fixing member includes a plate member disposed on a floor surface;

the front end side of the rotation mechanism is placed on the plate member;

the plate member is provided with the retractor mechanism; and the rotation mechanism is detachably connected to the plate member.

11. The fixing method according to claim 10, wherein:

the plate member is provided with a recessed portion; and a tip end side of the rotation mechanism is partially disposed in the recessed portion.

12. The fixing method according to claim 10, wherein a pair of the retractor mechanisms is provided such that the retractor mechanisms are disposed on respective ends of the plate member, and a tip end of the belt member pulled out from each of the retractor mechanisms is attached to each of right and left sides of the seating portion.

13. The pedaling exercise machine according to claim 9, wherein a tension of the belt member is adjusted when a tip end of the belt member pulled out from the retractor mechanism is attached to the seating portion.

14. The fixing method according to claim 9, wherein the seating portion is a wheelchair provided with wheels.

* * * * *